United States Patent [19]

Franco et al.

[11] Patent Number: 4,506,769

[45] Date of Patent: Mar. 26, 1985

[54] ACTIVITY BAG SYSTEM

[76] Inventors: Larry J. Franco; Jill Franco, both of 1812 Summer Cloud Dr., Thousand Oaks, Calif. 91362; Margaret K. Forino; Costante Forino, both of 31942 Kings Park Ct., Westlake Village, Calif. 91316

[21] Appl. No.: 425,313

[22] Filed: Sep. 28, 1982

[51] Int. Cl.[3] ..... A45C 3/00; A45C 13/00

[52] U.S. Cl. ..... 190/108; 190/110; 190/112; 190/115; 190/127

[58] Field of Search ..... 190/110, 109, 112, 108, 190/115, 127

[56] References Cited

U.S. PATENT DOCUMENTS

| | | | |
|---|---|---|---|
| D. 231,807 | 6/1974 | Berry . | |
| 504,840 | 9/1893 | Krick | 190/108 |
| 676,310 | 6/1901 | Goldberg | 190/102 |
| 1,521,260 | 12/1924 | Trachtenberg | 190/108 |
| 2,187,445 | 1/1940 | Botetho | 190/110 |
| 2,209,171 | 7/1940 | Plotkin | 190/110 |
| 2,425,035 | 8/1947 | Garnett et al. | 190/107 |
| 2,531,302 | 11/1950 | Schwennicke | 190/127 |
| 2,669,273 | 2/1954 | Keirsey | 190/110 |
| 2,767,758 | 10/1956 | Haynes . | |
| 3,521,690 | 7/1970 | Davis . | |
| 3,708,045 | 1/1973 | Katz | 190/115 |
| 3,830,348 | 8/1974 | Ohyama | 190/110 |
| 3,963,103 | 6/1976 | Cowen . | |
| 4,096,929 | 6/1978 | Frey et al. . | |
| 4,119,127 | 10/1978 | Klug . | |
| 4,164,968 | 8/1979 | Esposito, Jr. et al. . | |
| 4,260,004 | 4/1981 | Domke | 190/110 |
| 4,273,223 | 6/1981 | Tomlinson | 190/110 |
| 4,301,898 | 11/1981 | Plough et al. | 190/102 |
| 4,386,642 | 6/1983 | Durbin | 190/110 |

*Primary Examiner*—Joseph Man-Fu Moy
*Attorney, Agent, or Firm*—Klarquist, Sparkman, Campbell, Leigh & Whinston

[57] ABSTRACT

An activity bag system includes an outer carrying bag, multiple interchangeable inner containers carried one-at-a-time within the outer bag, and a container storage cover for each inner container which also serves as a partition for the outer carrying bag. Each inner container is divided by partitions into compartments for carrying the items needed for a particular sport or activity. At least some of the compartments are covered by a lid to which some items can be secured. The outer bag includes a lower section which receives the inner container and an upper lid section separated from the lower section by the inner container's storage cover. The inner container is placed within its storage cover when not being carried by the outer bag. The outer bag includes straps for securing large items to its outside surface and outside storage pockets, including an insulated pocket for carrying a container of hot or cold liquid.

1 Claim, 7 Drawing Figures

FIG. 5
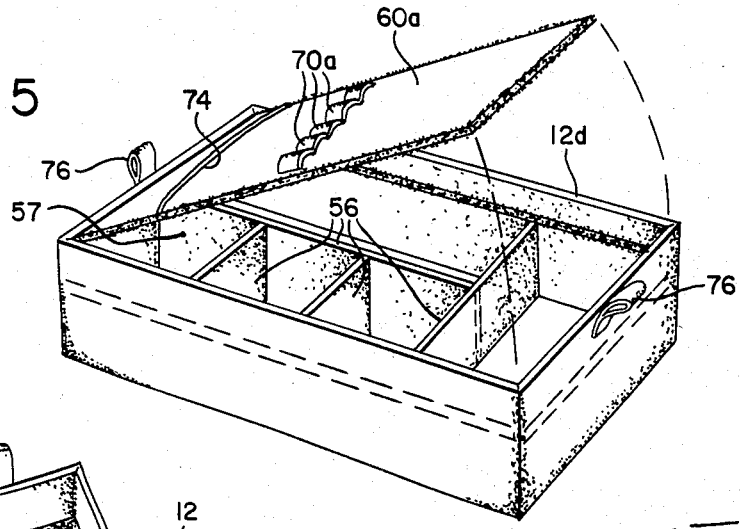
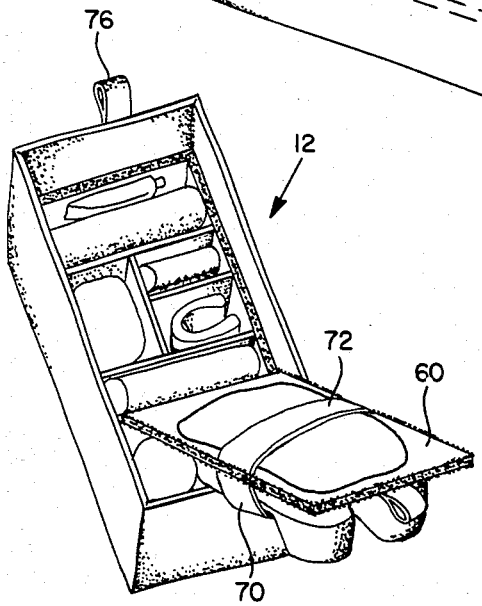
FIG. 6
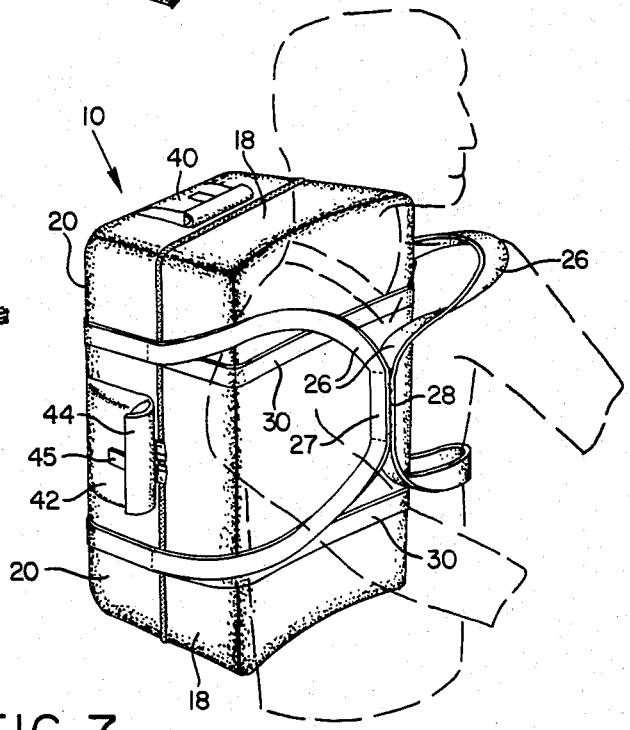
FIG. 7

ACTIVITY BAG SYSTEM

BACKGROUND OF THE INVENTION

The present invention relates to luggage or baggage for carrying articles and particularly to special purpose carrying bags designed for carrying articles for use in specific activities.

Luggage can be subdivided generally into two broad categories, namely, general purpose and special purpose. General purpose luggage is typified by the common suitcase in all its various hard-sided and soft-sided forms which can be used for carrying a large variety of men's and women's clothing and other items because of the large general character of its internal carrying compartments, which are usually formed by the outer case. Special purpose luggage is typified by, for example, compartmentalized camera accessory bags, back-packs, bowling ball bags, briefcases, and various other bags and cases shaped or compartmentalized to carry specific objects.

In general, both general and special purpose luggage consists of a single-unit case or bag which inherently limits its versatility and usefulness. For example, the common suitcase, although capable of carrying a large variety of clothing and other items, cannot do so in a very organized manner. On the other hand, a typical special purpose carrying bag or case, because of its overall size and shape or the specific size and shape of its internal compartments, is often capable of carrying articles for which it is designed in a very organized fashion, but has limited usefulness for carrying other items.

A further problem with both a general and a special purpose carrying bag or case is that neither provides any means for storing its contents when removed from it, especially in any organized fashion. Thus, if it is desired to use a carrying bag or case for storage of particular articles as well as for carrying them, the bag or case cannot be used for other purposes.

The foregoing problems suggest a need for a versatile multiple-use carrying bag or case that is capable of carrying at different times articles for various specialized activities, such as different sports and hobbies, in a highly organized and accessible fashion. A further need is to provide such a bag with some means for maintaining the articles for the various specialized activities in an organized fashion for storage when removed from the bag. Still another need is to provide such a bag with means that enable its quick and easy conversion and adaptation for carrying the articles peculiar to different specialized activities. Fulfilling these needs is the general objective of the present invention.

SUMMARY OF THE INVENTION

The foregoing needs are met by providing, according to the present invention, a multiple-part carrying bag system capable of carrying at different times items for multiple specialized activities in a highly organized fashion. The system is further capable of storing the items for some activities in an organized manner while articles for another special activity are being carried.

The multiple-part, special-activity carrying bag system of the present invention includes a common general purpose outer carrying bag and multiple, interchangeable inner containers which conform to the shape of a compartment of the outer bag so as to adapt them to be carried one-at-a-time within the outer bag. In the meantime, the other containers and their contents may be stored in their own individual dust-proof bags or covers. Each inner container may be compartmentalized by fixed or adjustable partitions for organizing the articles needed for a specific activity. Such inner containers may also include lids or partial lids for covering their compartments, and such lids may be provided with elastic straps or other means for securing sports shoes and other unwieldy items which do not fit conveniently within a compartment of the container.

The system may also include a third component, a combination laundry bag-partition-dust cover, one for each inner container. This third component may be used to contain and store the inner container when it is not in use within the outer bag, may also be used as a partition to form a pocket within the lid of the outer bag when its container is in the outer bag, and may also be used as a laundry bag for carrying wet or soiled items which need laundering, both within the outer bag while forming the pocket and when removed from the bag.

The outer bag may include various special features, including carrying straps that serve, alternatively, either as a handle or shoulder straps, an insulated pocket for carrying containers of hot or cold liquids, and securing straps for securing large items, such as tennis rackets and baseball bats, to the outside of the bag.

The result is a very versatile carrying bag system which can be adapted for use in carrying and organizing items for an almost infinite number of specialized activities from specific participatory and spectator sports and hobbies to the tools of tradesmen, professionals, and artisans.

The foregoing features, objects, and advantages of the present invention will become more apparent from the following detailed description which proceeds with reference to the accompanying drawings.

BRIEF DESCRIPTION OF DRAWINGS

In the drawings:

FIG. 5 is a perspective view of a typical inner container of the invention showing its lid in a partially open position;

FIG. 6 is a perspective view of an inner container portion of the invention with its lid in a full open position and its compartments filled; and FIG. 7 is a perspective view of the carrying bag system showing its use as a back-pack.

DETAILED DESCRIPTION OF PREFERRED EMBODIMENT

General Description Of Overall System

Figure 3:
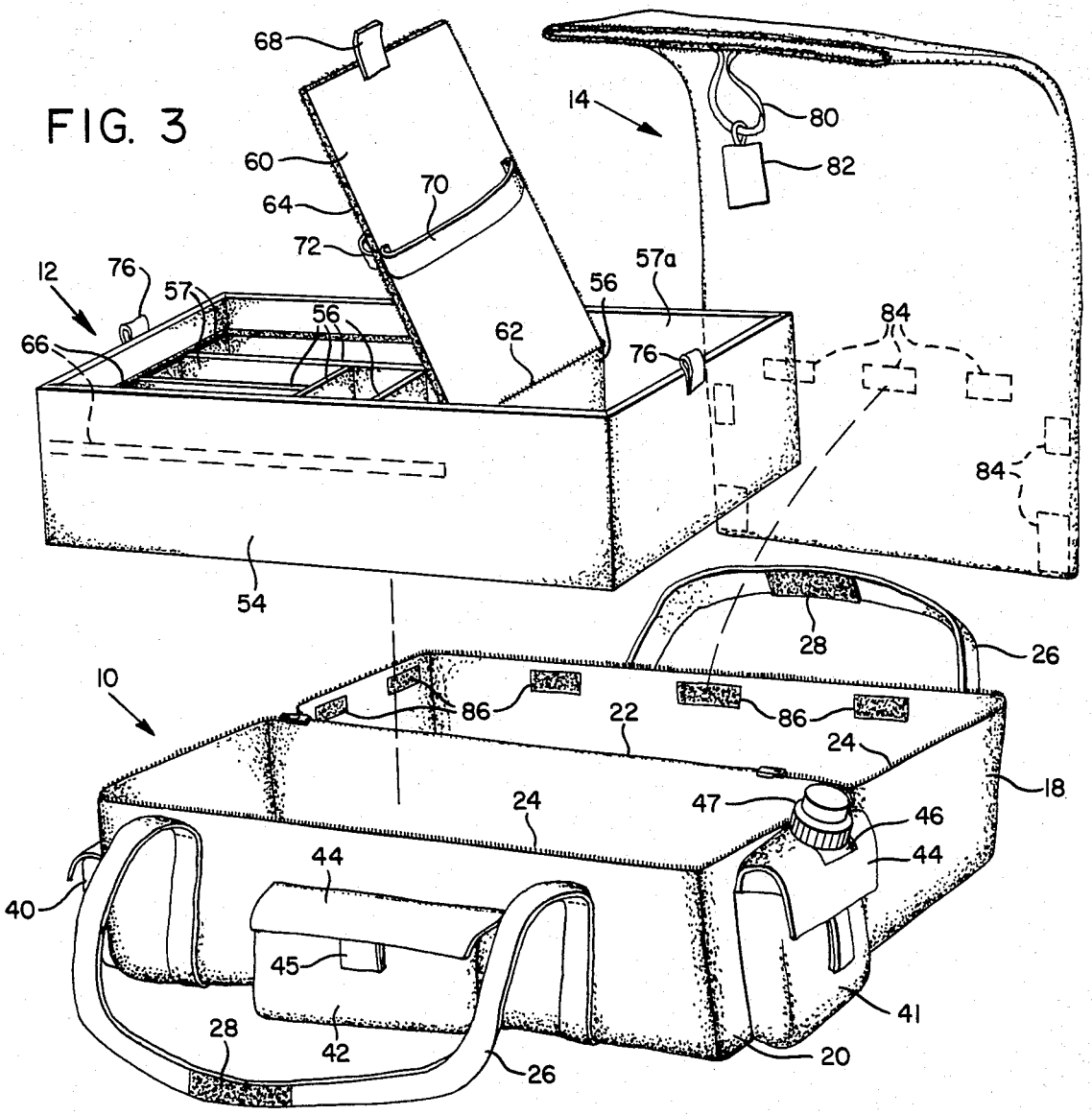
FIG. 3 is an exploded perspective view of the carrying bag system of the invention showing its three separable components.
Figure 4:
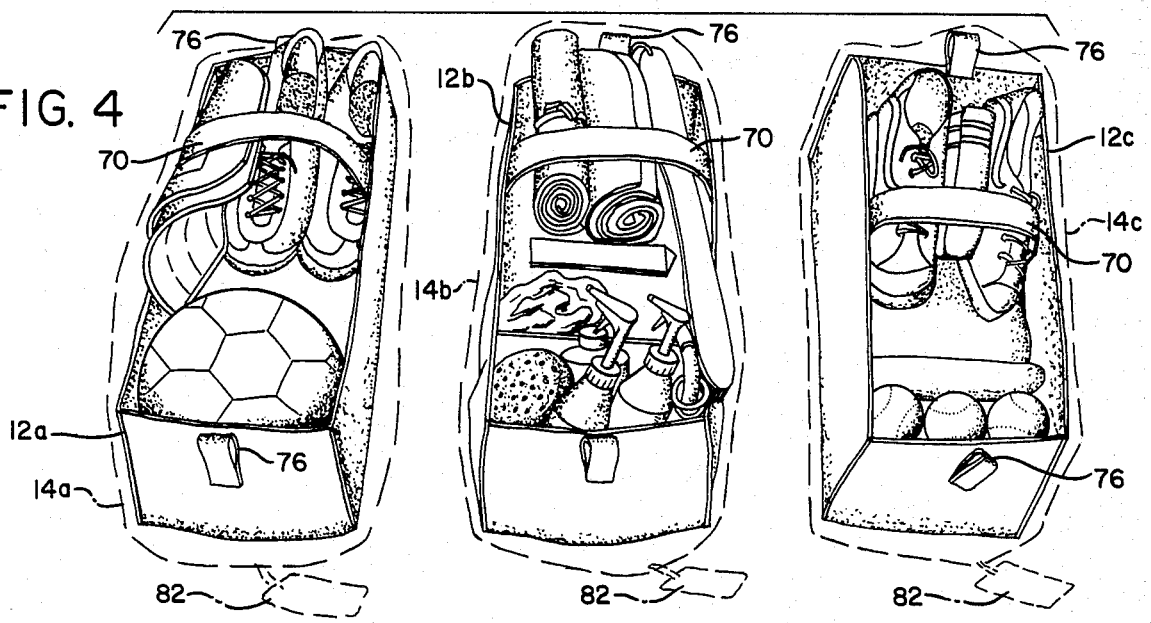
FIG. 4 is a perspective view of three interchangeable inner containers for use with the carrying bag system of the invention.

Referring first to FIG. 3, the overall system includes three basic components including an outer carrying bag 10 constructed of a strong, durable, flexible, and deformable material such as Cordura nylon or the equivalent, multiple, interchangeable inner containers 12 of a semi-rigid, self-supporting construction sized and shaped to fit in a close-fitting relationship within one section of the outer bag 10, and a combination container storage bag-outer bag partition-laundry bag 14. Three of the inner containers 12 are depicted in FIG. 4 in a filled condition, each of which is removably interchangeable with the others within the outer bag 10. Such inner containers include, for illustrative purposes, a first inner container 12*a* containing the necessary articles for soccer, including ball, shoes, and shin guards, a second inner container 12*b* containing the necessary articles for equestrian activities, and a third inner container 12*c* containing the necessary articles for tennis with shoes and tennis balls shown. In FIG. 4, these three containers are shown removed from the outer bag for storage within their individual storage bags 14*a*, 14*b*, and 14*c*, depicted in phantom lines in FIG. 4.

With the carrying bag system as described, a single outer bag 10 can be used selectively to carry at different times each of several inner containers 12, each adapted and filled with articles for carrying on a particular participatory or spectator sport or other specialized activity. When an inner container 12 is not used to carry the articles for its special activity, it can be used to store the articles for that activity outside of the carrying bag in its own storage or dust cover 14, as illustrated in FIG. 4. In this way, the articles for any one of the large number of different specialized activities can always be maintained in an organized manner ready for use at a moment's notice, and transported simply by removing one inner container from the outer carrying bag and replacing it with a selected one of other inner containers containing the articles desired for the next activity. In any case, the inner container 12 is removed from its storage cover 14 before being placed in the outer bag for transport.

Figure 2:
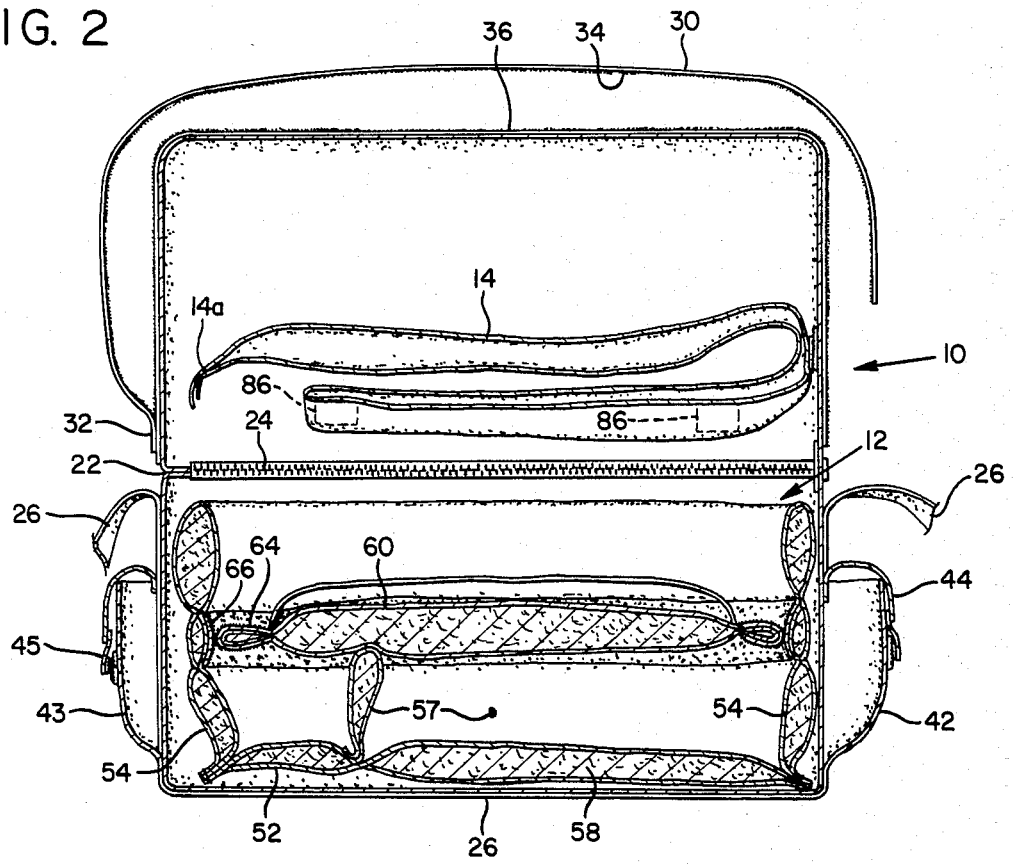
FIG. 2 is a vertical cross-sectional view taken approximately along the line 2—2 of FIG. 1, showing an inner container and a storage bag-partition within the outer carrying bag.

According to another feature of the invention, the storage cover 14 is adapted for use as a partition within the outer carrying bag 10 when not being used for storing its inner container. This is best shown in FIG. 2 where the cover 14 is shown secured to inner sidewalls of the upper lid section of carrying bag 10 to partition the lid section internally from the lower section of the carrying bag. When thus secured, cover 14 defines a pocket 16 for carrying articles of a more general nature, such as uniforms or clothing for a particular sport or activity. This feature of the storage cover 14 will be described in greater detail later.

Outer Carrying Bag

Figure 1:
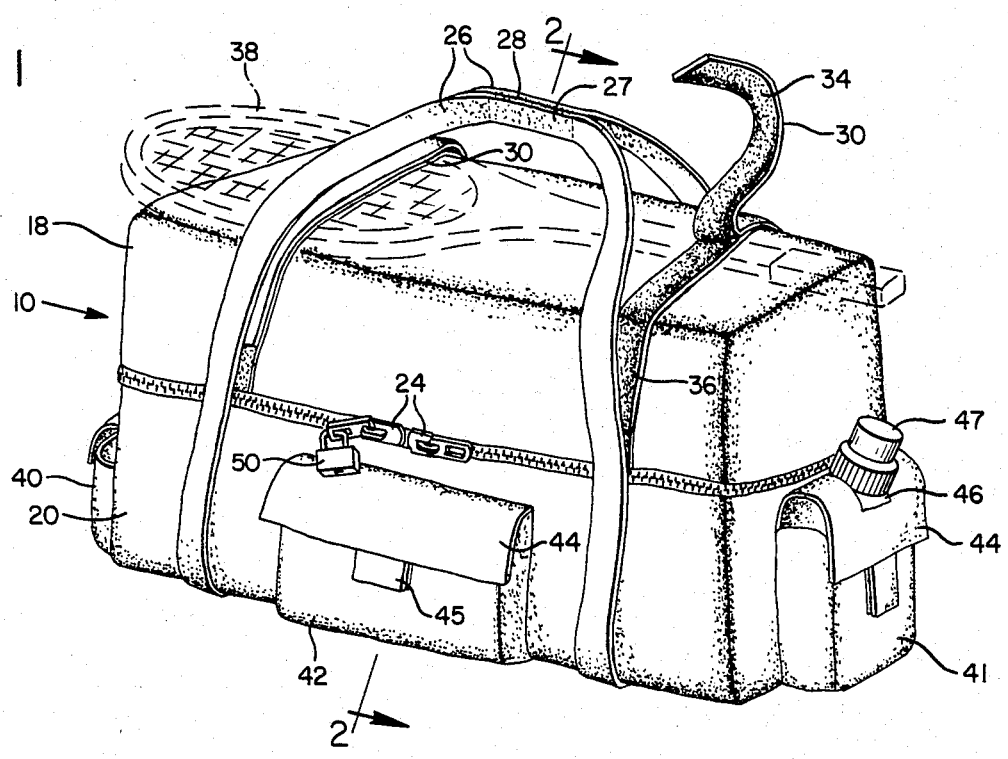
FIG. 1 is a perspective view of an outer carrying bag portion of the system of the invention.

Referring especially to FIGS. 1–3, outer carrying bag 10 is divided horizontally into two sections of approximately equal volume, including an upper lid section 18 and a lower container-receiving section 20. The overall shape of the carrying bag is generally rectangular, although deformable. Lid section 18 is separable from lower section 20 along three sides of the bag, as shown best in FIG. 3, and the two sections are hinged together along the fourth side at an integral fabric hinge 22. Closure means in the form of zippers 24 are provided along the parting edges of the three separable sides of the bag to fasten the lid and lower sections together in a closed position for carrying the contents of the bag.

Flexible loop-type carrying straps 26 are secured to the lower section of the bag and extend upwardly on opposite sides of the bag over the upper lid section 18, where they can be joined together to form a handle at 27 for carrying the bag as a tote bag in the usual manner. Fastening means such as the hook and loop-type closure tape shown, commonly sold as Velcro brand closure tape, are provided along the inner surfaces of the pair of loop straps 26 where they converge, as shown best at 28 in FIG. 3, to join the straps together and form handle 27. Each of the pair of straps 26 is preferably sewn to the outer surface of the lowr bag section 20 along the full length of that portion of the strap extending about the lower section to form a strong and solid connection between the straps and the bag and to stabilize the bag while being carried by the straps.

Another feature of the outer bag is its ability to be used as a back-pack. To accomplish this, the pair of loop straps 26 are used as shoulder straps in the manner shown in FIG. 7. The arms of the carrier are inserted through each of the separated loops formed by the two straps, and then the two straps are joined together by the Velcro tape 28 at the chest of the carrier to prevent inadvertent slippage of the straps from the shoulders. Carrying bags 10 of large size or with heavy loads will be most conveniently carried in this manner.

An advantageous feature of the outer bag is its means for securing to the outside of the bag those articles which are so large or oddly shaped that they would not fit conveniently within such bag. Such securing means includes a pair of securing straps 30 fastened at one set of ends 32 to the lid section 18 near its hinge with the lower section. The straps are sufficiently long to extend up one sidewall, across the top, and down the opposite sidewall of the lid, as shown best in FIG. 2. The inner surfaces of the straps 30 are lined with Velcro fastening tape 34 along their full lengths. Underlying outer surface portions of lid section 18 are provided with coacting strips 36 of such tape so that the full free length of each strap 30 can be fastened down to lid section 18. Articles such as the tennis racket 38, shown in phantom in FIG. 1, can be secured to lid section 18 by placing the article across lid strips 36 and then extending straps 30 tightly over the article and down against strips 36.

The lower section of the outer bag includes end pockets 40, 41, and side pockets 42, 43, each with a cover flap 44 and an attached lifting tab 45. The inner surface of each tab is lined with Velcro fastening tape which coacts with a patch of such tape on the outer surface of the pocket to hold the flap 44 down over the pocket. One end pocket 41 is preferably lined with an insulating material (not shown) for carrying a bottle or other container of hot or cold liquid. The flap 44 of insulated pocket 41 has an aperture 46 through which the neck of a bottle 47 projects when its flap 44 is closed. Additional outer storage pockets (not shown) could be provided on the lid if desired. The pair of zipper closures 24 may also be provided with a padlock 50 for locking the lid and lower sections together with the zippers closed.

Inner Container

With reference especially to FIGS. 2, 3, and 4, each of the several inner containers 12 is generally rectangular in shape and has a bottom wall, four sidewalls, and an open top. Each is sized to fit closely within the lower section 20 of the outer bag to substantially fill such section. Thus, all of the several inner containers 12 have the same overall outer shape and dimensions.

The interior of each container 12 is subdivided by partitions 56 into compartments 57 of various sizes and shapes to accommodate various articles to be carried within the container. The compartments 57 of different containers may differ in size, shape, and arrangement, depending on the sport or activity for which each container is designed, so long as their outer dimensions are substantially the same for a given outer carrying bag 10.

Alternatively, all inner containers for the same outer bag may have their partitions arranged the same so that the size, shape, and arrangement of compartments is the same for each one. Thus, the containers would be completely interchangeable, and large inventories of specialized inner containers would not need to be kept on hand.

A third alternative is to provide each of the inner containers 12 with movable partitions which can be selectively rearranged to change the size and shape of its compartments if desired for accommodating articles of a particular activity. For example, in the preferred embodiment each inner container has sidewalls, a bottom wall, and partitions which are of padded fabric construction. To make the partitions 56 changeable to change the size and shape of inner compartments 57, the ends of the partitions can include strips of Velcro-type fastening tape. The inner sidewalls of the container and partitions can be lined with randomly placed horizontal strips of Velcro tape. This would enable interconnection of the partitions and container sidewalls in different patterns to form compartments of different sizes and shapes, and would allow the partitions to be shifted from one position to another within the sidewalls of the inner container when desired.

The container and partition walls may be made of the same fabric material as the outer container but filled with a semi-rigid foam or other padding such as a polyester fill material. In any case, each inner container has a self-sustaining shape which is preferably well-padded to protect its contents. A typical sewn construction of the inner container is best shown in FIG. 2, wherein the padded bottom wall 52 is shown sewn to the opposite sidewalls 54, with padded inner partitions 57 shown sewn to the bottom wall 52, sidewalls 54, and to each other. In all cases the partition and container walls are shown to be filled with a padding fill 58.

Each container 12 has at least a partial cover or lid 60 of padded construction similar to that of the container and partition walls. The lid is hinged to one of the transverse partitions 56 by an integral fabric hinge 62. Lid 60 is designed to extend when closed over all of the smaller compartments 57, leaving a single large compartment **57*a* uncovered for containing larger articles such as the soccer ball shown in the container 12*a* of FIG. 4. Fastening means hold the lid down in its closed position. The illustrated fastening means include Velcro-type closure tape, including strips 64 of such tape extending along the three peripheral edges of container lid 60 and cooperative tape strips 66 lining the inside sidewall portions of the container to coact with lid strips 64. The free end edge of the lid also has a lift tab 68** to facilitate pulling the lid open from its closed position.

The upper edges of partitions 56 terminate below the upper edges of container sidewalls 54, and therefore lid hinge 62 also lies below the upper edge of the container sidewalls. Thus when the lid is closed there is substantial space between the top of the lid and the upper edges of the container sidewalls. This provides space for storing items such as shoes, hats, and towels, too large for covered compartments 57, within the container but on top of the lid. An elastic band 70 fastened to the lid at its opposite edges extends across the top of the lid for securing such items beneath it and against the top of the lid. Use of the band in this manner is best shown in FIG. 4.

Another elastic band 72, shown in FIG. 6, may extend across the inside of lid 60 to hold other items, such as the crushable hat shown, to the underside of the lid. If desired, the container may include a full lid **60*a* shown on the container 12*d* in FIG. 5, thereby providing a complete cover for all of the internal compartments 57 of the container. The lid may also include straps, bands, or other securing means 70*a*, shown on the lid of container 12*d*, which do not extend the full width of the lid. Such partial width bands are especially suitable for securing film cases to the lid of a container particularly designed for photographic equipment. Also as shown with respect to container 12*d*, the lid may include a pocket 74** for containing instruction booklets or the like.

Because each inner container fits snugly within the lower section of the outer bag, each inner container is provided with lifting loops 76, one at each of the opposite ends of the container, for use in lifting the container from the outer bag.

In FIG. 3 a typical container 12 is shown with its partial lid open and with its compartments 57 empty. In FIG. 5 a modified form **12*d* of the container is also shown empty and with its full lid partially open. In FIGS. 4 and 6 several containers 12 of basically the same design are shown filled with the specialized contents of a particular activity. In FIG. 6 the filled container 12 is shown with its partial lid fully open. In FIG. 4 three filled containers 12*a*, 12*b*, and 12*c* are shown with their partial lids closed and with articles for soccer, equestrian activity and tennis, respectively, secured by a band 70** to the tops of their respective lids.

In general, the inner containers 12 are of a more rigid and shape-sustaining construction than the very flexible and deformable outer bag 10, even though the inner containers may be formed of relatively flexible soft deformable materials. Nevertheless, because of the more rigid construction of the inner containers than the outer bag and the close-fitting relationship between the lower section of the outer bag and the inner container, the inner container when inserted into the lower section of the outer bag helps shape and rigidify the outer bag, facilitating its handling.

Although the inner containers in the illustrated embodiments are made of soft deformable materials, such containers could also be made of more rigid materials such as sheet plastics, wood, or other board products. However, it is believed that use of such more rigid materials would increase the rate of wear of the outer bag and thus reduce its useful life.

Container Storage Cover-Partition

The container storage cover or bag 14 is an important element of the total system. Referring to FIG. 3, it is basically a lightweight fabric bag having a drawstring closure 80 at its open end. The drawstring carried an identification tag 82 for identifying the container 12 which a particular bag 14 is intended to cover, according to the sport or other activity items which its container carries.

One basic function of storage bag 14 is to cover its associated container 12 for storage when the container is not being used or carried in outer bag 10. It thus protects the filled container from dust and dirt while preventing loss of its contents.

Another basic function of bag 14 is as a partition for outer bag 10 when its container is carried within the outer bag. This function is shown in FIG. 2. There bag 14 extends across a bottom portion of lid section 18, partitioning it from lower section 20 of the outer bag and forming the large compartment or pocket 16 within which large items such as uniforms and other clothing can be carried.

To hold bag 14 in place as a partition in lid 18, securing means are provided. Such means include patches 84 of Velcro-type fastening tape arranged near the bottom of bag 14 to mate with similar patches 86 of such tape along the inside walls of lid 18. When the bag patches 84 are secured to lid patches 86, bag 14 forms the desired partition. Preferably, one side of the partition remains open enabling clothing to be inserted into or removed from lid compartment 16 without removing the partition.

By affixing the bottom portion of one side of bag 14 to the lid, the bag opening 14*a* (FIG. 2) remains accessible while the bag serves as a partition. This enables soiled or wet clothing to be inserted into the bag while it continues to serve as a partition.

When bag 14 is detached from lid 18, it also can serve as a laundry bag for soiled clothing resulting from the particular sport or activity for which a particular container 12 is used.

Having illustrated and described the principles of our invention by what are presently preferred embodiments, it should be apparent to persons skilled in the art that such embodiments may be modified in arrangement and detail without departing from such principles. We claim as our invention all such modifications coming within the true spirit and scope of the following claims.

We claim:

1. An activity bag system comprising in combination:

an outer flexible collapsible fabric carrying bag separable along closure means into upper and lower sections to divide the bag, respectively, into upper and lower inner storage compartments of substantially equal volume;

a pair of carrying straps attached to the lower section and extending upwardly from the opposite outer sides of said lower section over said upper section and adjustably joined by fastening means to provide alternatively a carrying handle and adjustable shoulder straps for carrying the outer bag as a back-pack;

securing means attached to the outer bag for securing articles to the outside of said bag;

multiple interchangeable self-supporting inner storage containers separate from and insertable alternatively one-at-a-time into said lower compartment of said outer, bag, each said container having substantially the same outer dimensions and shape and each sized to closely fit and substantially fill the lower compartment of said outer bag to shape and provide rigidity to a portion of the outer bag defining the lower compartment while enabling unrestricted access to the upper compartment, each said inner container comprising:

sidewalls and divider means partitioning said container inwardly of said sidewalls into multiple compartments for containing selected articles in an organized manner for carrying within said outer bag and for storage of said articles apart from said outer bag;

a lid hinged to a sidewall for covering at least some of said compartments, securing means attached to said lid for securing articles to said lid, cooperative closure means attached to said sidewalls and lid for securing said lid in a closed position over at least some of said compartments, and a partition means removably fastened to the interior of said outer bag to separate the upper and lower compartments for retaining items within the upper compartment, said partition means comprising a container storage bag sized and shaped to receive one of said inner containers for storage apart from said outer bag when said partition is removed from the interior of said bag.

* * * * *